US005505154A

United States Patent [19]

Urie, Jr. et al.

[11] Patent Number: 5,505,154

[45] Date of Patent: Apr. 9, 1996

[54] BOAT BOTTOM SCRUBBING DEVICE

[76] Inventors: Lawrence J. Urie, Jr., 31 W. Green Hill Rd., Broomall, Pa. 19008; Lawrence E. Urie, 1403 Hunting Wood Dr., Annapolis, Md. 21403

[21] Appl. No.: 325,493

[22] Filed: Oct. 19, 1994

[51] Int. Cl.[6] ..... B63B 59/00

[52] U.S. Cl. ..... 114/222; 15/160

[58] Field of Search ..... 114/222; 15/160

[56] References Cited

U.S. PATENT DOCUMENTS 2,739,330 3/1956 Hitchcock ..... 15/160

3,336,617 8/1967 Bosko et al. ..... 15/160

5,375,287 12/1994 Dillahunt ..... 15/160

FOREIGN PATENT DOCUMENTS 2465568 4/1981 France ..... 114/222

*Primary Examiner*—Jesús D. Sotelo

*Attorney, Agent, or Firm*—Frederick J. Olsson

[57] ABSTRACT

The device includes a tubular support which has a contoured section compatible with the curvature of boat hulls, a scrubbing brush on one end of the support and a loop-type tubular handle section on the opposite end of the support. The handle section has a pair of spaced apart, parallel hand-grips. The support and handle section are co-planar.

3 Claims, 2 Drawing Sheets

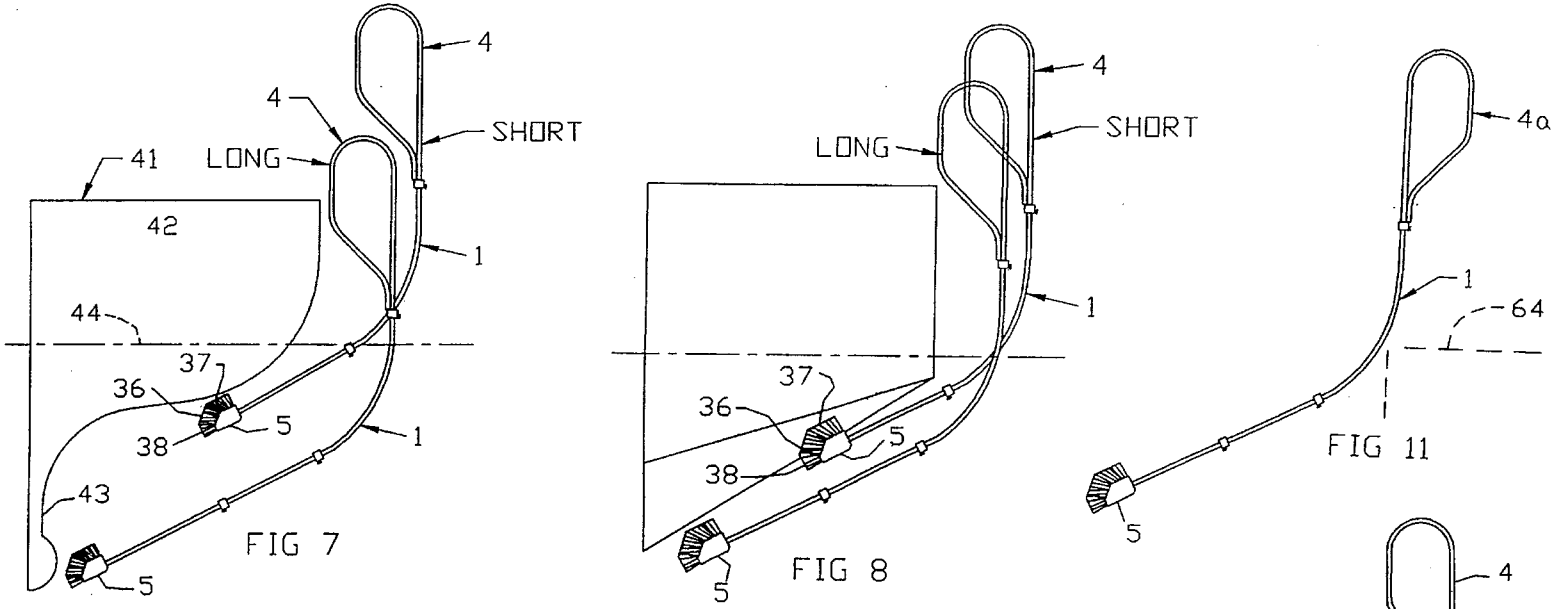
FIG 7
FIG 8
FIG 11
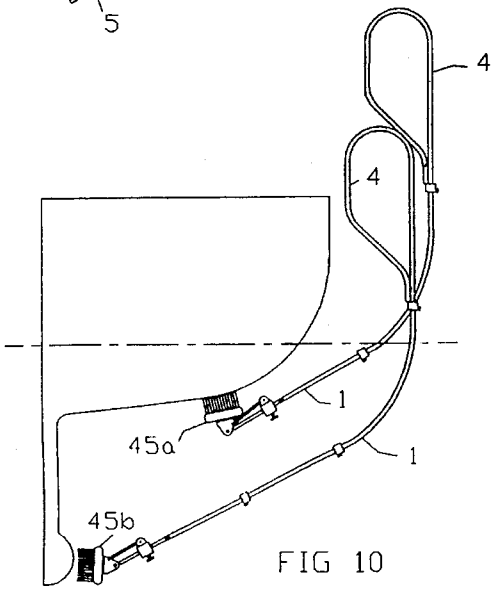
FIG 10
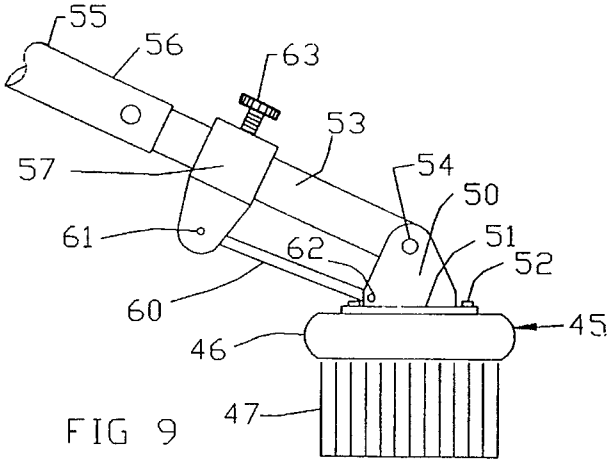
FIG 9

BOAT BOTTOM SCRUBBING DEVICE

This invention relates in general to pleasure-boat maintenance equipment and in particular relates to device for removing contaminants such as slime, algae, grass, barnacles and the like from the bottom of motor and sail boats while the same are in the water. The term bottom includes the hull, keel, and rudder.

In one aspect, the invention contemplates a manually operable scrubbing device comprised of a bristle-type brush mounted on support means manipulated by an operator to move the brush up and down against the bottom while the operator stands on the deck of the boat or alternatively on the mooring dock.

In another aspect, the invention contemplates a device of the kind in question having brush meads contoured to accommodate different bottom configurations and having space apart, two-hand gripping means, the contour and the two-hand gripping means generating a mechanical advantage to maximize the pressure exerted by the brush on the contaminants.

In another aspect the invention contemplates a device of the kind in question having a bristle-type scrubbing brush the outer ends of which are arranged to provide that different slopes or configurations of a boat, bottom will be engaged by a scrubbing surface and therefor making it unnecessary to replace the brush or adjust the same to ensure scrubbing contact.

In another aspect the invention contemplates a device of the kind in question having a bristle-type scrubbing brush wherein the locus of the outer ends of the bristles forms a plurality of differently oriented scrubbing surfaces respectively adapted for different slopes of the bottom with the correct surface being automatically presented for scrubbing as the brush is moved up and down.

In another aspect the invention contemplates a device of the kind in question wherein the brush support means is in the form of follow, air-tight tubing which, while in water, creates an upwardly directed buoyancy force to increase the pressure of the brush on the contaminants.

In another aspect the invention contemplates a device of the kind in question having brush support means in the form of sections of hollow tubes joined by coupling means which provide for disassembly for storage purposes and when assembled maintains the tubing in airtight condition.

In another aspect the invention contemplates a device of the kind in question having a bristle type scrubbing brush with the locus of the outer ends of the bristles forming a substantially flat surface, the brush being mounted on the brush support means providing that the brush can be rotated or pivoted to place the scrubbing surface in a position as a function of the bottom contour and so position the surface to enhance the scrubbing ability.

The invention will be described below in connection with the following drawing wherein:

FIG. 7 is an elevational view for illustrating movement of the brush of the device of FIG. 1 for cleaning the bottom of typical sailboat with the operator positioned on the boat;

FIG. 8 is an elevational view for illustrating movement of the brush of the device of FIG. 1 for cleaning the bottom of a typical motor boat with the operator positioned on the boat;

FIG. 9 is an elevational side view illustrating a pivoting type of scrubbing brush;

FIG. 10 is an elevational view for illustrating how the scrubbing surface of the brush of FIG. 9 can be oriented to insure cleaning the bottom of a boat having severe slopes; and FIG. 11 is a fragmentary elevational view illustrating how the device is arranged for cleaning with the operator standing on the mooring dock.

Figures 1, 2, 3, 4, 5, 6:
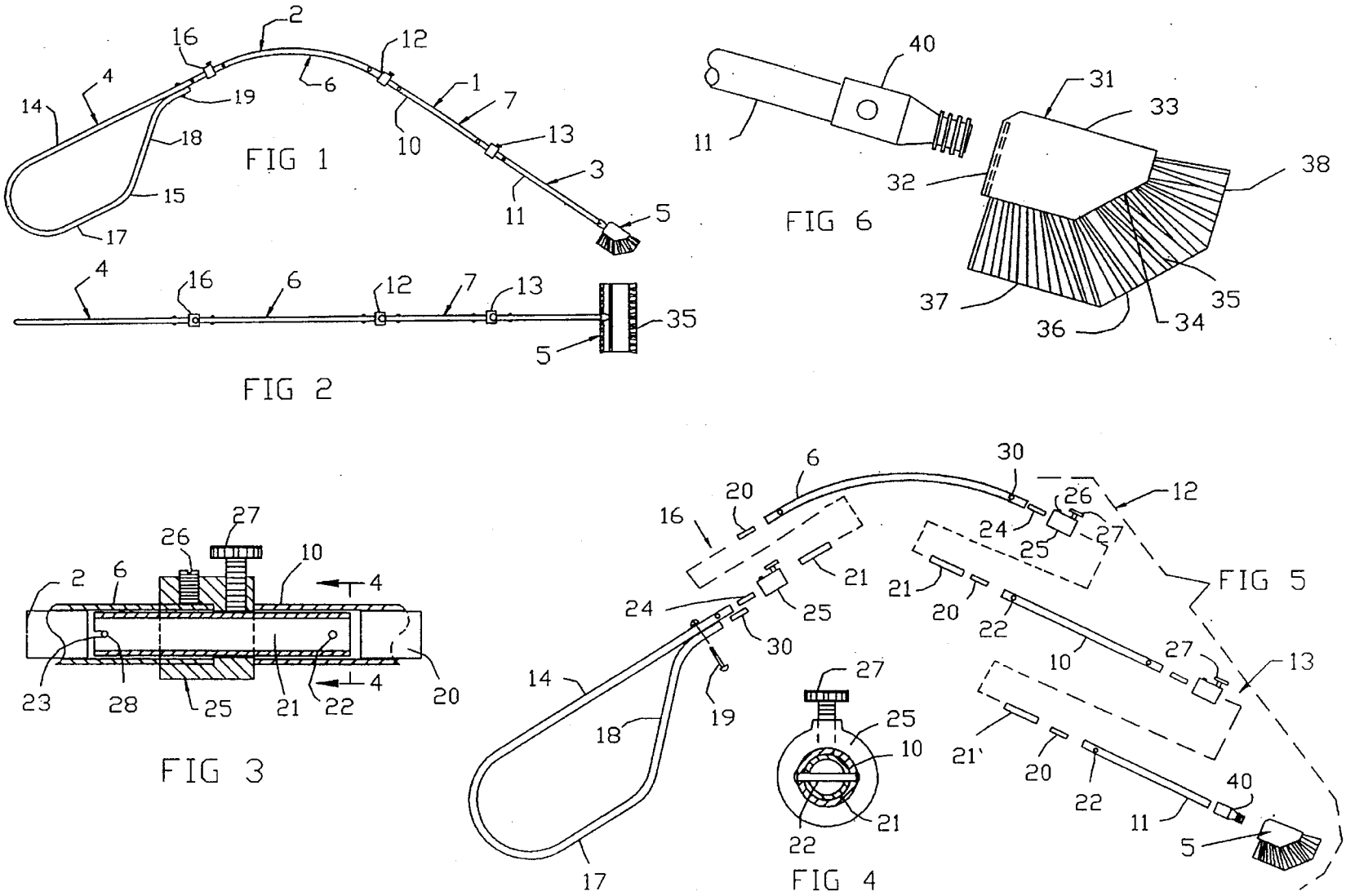
FIG. 1 is side view of a device constructed in accordance with the invention.
FIG. 2 is a top view of the device shown in FIG. 1.
FIG. 3 is an elevational view of a coupler used in the device of FIG. 1.
FIG. 4 is view partially in section taken along the lines 4—4 of FIG. 3.
FIG. 5 is an exploded view of the device of FIG. 1 illustrating the manner of assembling the tubular components by using the coupler of FIG. 3.
FIG. 6 is an enlarged side view of the brush of FIGS. 1, 2, and 5.

In FIGS. 1 and 2, the device includes an elongated support 1 having first and second ends 2 and 3, an operating handle 4 located at the end 2 of the device and a brush 5 located at the end 3 of the device. The support 1 has a longitudinal center axis which has the same contour as the support. The axis is not shown for purpose of clarity.

The support 1 is comprised of serially arranged tubular members particularly the concave member 6 and the straight member 7. The straight member 7 has an extension component 10 and brush component 11. The concave member 6 and the straight member 7 are joined by a coupler 12 and the extension component 10 and the brush component 11 are joined by coupler 13.

The couplers 12 and 13 have identical structure which will be described later. The coupler 12, permits the concave member 6 and the extension component 10 to be easily connected or disconnected. The coupler 13 permits the extension component 10 and the brush component 11 to be easily connected or disconnected.

The extension component 10 can be completely removed from the device and the brush component 11 joined to the concave member 6 by coupler 12. This arrangement provides for changing the overall length of the device to accommodate hull and/or keel size. Naturally, extension components of differing lengths can be employed.

The operating handle 4 is reverse bent so that it has a loop configuration including the spaced-apart hand grip sections arid 15. The operating handle 4 is secured to the end 2 of the support by the couplet 16. This coupler has the same construction as couplers 12 and 13.

The grip section 14 is straight. The grip section 15 has a straight part 17 and a straight part 18 oriented at art angle to part 17. The hand grip section 14 and the hand grip section 15 and spaced-apart. The section 14 and part 17 are parallel. The part 18 is oriented at an angle to section 14. The grip sections 14 and Part 18 are secured together by the nut/bolt assembly 19.

The handle 4 has an axis which partakes of the straight and curved forms of the handle. The axis is not shown. The axis of the handle 4 is coplanar with the axis of the support 1 as is evident from an inspection FIG. 2.

In FIG. 1, the operating handle 4 faces or extends in a direction toward the inside of the concave form of member 6 as generally indicated by arrow A. It might be noted at this point that the cleaning mechanism on brush 5 also extends or faces in the same direction as indicated by arrow B.

The structure of the couplings 12, 13, and 16 will be described in connection with FIGS. 3 and 4 which depicts the coupling 12. A plug 20, preferably made of cork having a slight taper, is inserted inside the tubular extension component 10 to engage the inside wall so as to seal off the entry of air. An elongated connector 21 is also inserted in the component 10 and extends away from the end. A rivet 22 extending through the component 10 and through the connector 21 locks the connector 21 in position. The outer end of the connector 21 is slotted as noted at 23.

The concave member 6 is also provided with a cork plug 24 for air sealing purposes. A block 25 can slide over the end of the concave member 6. The block carries a set screw 26 and a knob 27 both threaded in the block. The concave member 6 carries a rivet 29 which extends across the inside and is flush with the outside surface.

The foregoing is assembled as follows. The plug 20 and connector 21 are inserted in the extension 10 and the rivet 22 put in place to secure the connector. The set screw 26 and knob 27 are backed-off and the block moved over the connector 21 until the block engages the end of the extension component 10 then the concave member 6 is pushed into the shouldered cavity 29 on the block 25. The set screw 26 is turned down so that the block 25 and concave member 6 are tightly engaged. The knob 27 is turned down so that the connector 21 add extension 10 are tightly engaged. Referring to FIG. 5, the parts of the coupler 12 described above have the same numbers. With respect to coupler 16 the corresponding number are used and each has a prime sign. The end of the tubular hand grip section 14 corresponds to the end of the concave member 6 and the left hand end of the concave member 6 corresponds to the left hand end of the extension 10.

It will be noted in connection with the coupler 16 that a plug 31 is used for sealing purposes.

The brush 5 shown in FIGS. 1, 2, and 5 will next be described.

The brush 5 has a base 32 formed with a outside surfaces 32 and 33 and a bristle surface 34. The bristles 35 extend outwardly from the bristle surface 34. Referring to FIG. 2, the bristles extend parallel to the axis of the support 1 or parallel to the plane of the support. The bristles are secured to the surface 34 in the conventional manner. In most instances, the bristles are relatively long so as to be flexible (usually between 2½–3 inches). Less flexible or stiffer bristles are obtained by making the bristle shorter in length (usually between 1½–2 inches). For the long bristles the ends ate flagged. For the short bristles the ends are crimped.

The bristles are arranged in three groups. There is a center section 36 and oppositively disposed outboard sections 37 and 38.

In each section, the bristles are cut so that the locus of the outer ends of the center section lie substantially in a plane and the outer ends of the outboard sections are cut so that the locus of the ends lie respectively in planes oriented at an obtuse angle to the plane of the center section.

The manner in which the brush 5 is secured to the brush tubular brush component 11 will be explained in connection with FIG. 5.

The tubular component 11 has a threaded nipple 40 and the brush base 31 has a threaded hole extending inwardly from outside surface 33. A holder screw is inserted into the base from outside surface 33 to hold the nipple 40 and tubular component 11 in position. After the plug 20" and connector 21" have been inserted in the tubular component 11, the rivet 22" is inserted to hold the connector 21". The remaining components of the coupler 13 are assembled as described for coupler 12. The slot (not shown) in the connector 21" and the axis of the rivet 22 are aligned with respect to the base 31 to insure that bristles extend outwardly particularly the bristles of section 37 in the direction indicated by arrow B. As noted in FIG. 2, all of the bristles are parallel with a vertical plane containing the axis of the support 1. Also, as will be observed from a inspection of FIG. 5, the planes of the outer edges of the bristles of sections 37 and 38 are respectively parallel and perpendicular to the axis of the brush component 11.

It will be apparent that for brush replacement purposes, the assembly comprising the brush 5, nipple 40, and brush component 11 can be removed simply by backing off the knurled knob 27" of coupler 13 and then replacing with another assembly.

The configuration and orientation of the bristles as described above just is preferred because the same provide for a brush that is fixed in place with the capability to scrubbing the hulls and keels conventional configuration from either a deck or a dock and without changing fixed brushes or pivoting the brush, the latter being described in connection with FIG. 9.

The manner of using the brush for cleaning or scrubbing purposes is illustrated in FIGS. 7 and 8.

FIG. 7 illustrates the typical configuration of a sail boat 41 having a hull 42 and a keel 43. The boat is in the water, the surface of which is indicated at 44. The boat is tied up at a dock or is anchored.

The device is used by starting at either the bow or stern of the boat and working toward the opposite end. The left and right hands of the operator grasp the hand grip sections 14 and 15 raising the brush to the water line engaging the hull and then scrubbing an area by moving down and up over a short distance. The scrubbing action is repeated enough times to dislodges the contamination. The brush is then positioned further down on the hull to another area and area is scrubbed.

The foregoing is repeated all the way down to the end of the keel. When the scrubbing action is done on one vertical area, the action repeated on one area after the other along the length or the boat.

By virtue of the structure of the operating handle, a scrubbing force can be exerted on the hull and keel by moving the hands so that the device tends to rotate in a direction to force the brush inward.

With respect to FIG. 8, the same procedure as described above is employed. It is pointed out that where the motor boat hull has one or more skegs, the brush will easily ride over and cleans the same. Usually, it is preferred to scrub the vertical area between a pair of skegs along the length of the boat and then go back and scrub the area between the next adjacent pair.

As previously mentioned the device can be used with and without the extension component 10 as shown in FIG. 1, depending upon the size of the hull and particularly the size of the keel. This is illustrated in FIG. 7 and in FIG. 8 wherein the device labelled "Short" has the extension removed wherein the device labelled "Long" has the extension included.

From an inspection of FIG. 7 and 8, it will be apparent that the orientation of the three flat surfaces 36, 37, and 38 provide an arrangement by which a set of bristles is able to contact the surface irrespective of the brush position. Naturally, in some areas more of the bristles will make contact than in the other areas. The fewer contact condition is compensated for by adding a few more scrubbing strokes.

Because the particular shape of some hulls and keels and/or because the contamination is so heavy full bristle contact is desirable, In FIG. 9 and 10, I have illustrated a brush for such conditions.

In FIG. 9, the brush 45 is comprised of a base 46 and bristles 47. The brush 45 is rectangular in shape, having a length about the same as brush 5. The bristles 47 are secured in a conventional manner and are of the same type as previously mentioned. The locus of outer ends of the bristle 47 is planar.

A yoke 50 is secured to a plate 51 which is secured to the base 50 by using wing nuts 52 on threaded studs extending up from the base. A rod 53 is connected to the yoke 50 by pivot 54. The rod fits inside of brush component 55 (same as component 11) and is held in pace by rivet 56. A slider 57 is mounted on rod 53 so that it can be moved back and forth on the rod. A link 60 is connected to the slider by pivot 61 and also is connected to the yoke 50 by pivot 62. The slider 57 is secured in any position along the rod by turning down the curled knob 63.

By moving the slider 57, the brush 45 rotates about the axis formed by pivot 54.

The rod 53 is secured to the brush component 55 so that the axis of pivot 54 is normal to be plane containing the support and operating handle.

It will be apparent that the brush 45 is replaceable by removing wing nuts 52.

FIG. 10 illustrates a boat having a bottom configuration where changing the position of the brush with respect to the support is desirable. In FIG. 10, the brush 45*a* (in the upper location) has been adjusted so that the bristles extend at an acute angle with respect to the axis of the support of almost 90 degrees. In the lower part the brush 45*b* has been adjusted whereas the bristle extend out at large obtuse angle. In the event it is necessary or desirable to conduct the cleaning operation which standing on a mooring dock, the device of the invention can be readily adapted for this purpose, in FIG. 11, the operating handle 4*a* (same as handle 4) has been reversed in position with respect to the position shown in FIG. 7 and 8.

In FIG. 11, it will be seen that the loop extends in a direction away from the concave member 6. The operator stands on a dock indicated by the dotted lines 64.

Before closing there are a couple of features which we will discuss.

First of all the base members 31 and 45 of the brush 5 and 45 may be formed of foamed plastic for purposes of enhancing the buoyancy effect discussed earlier. Next; the identical structure of the couplers 12, 13, and 16 provide for interchangeability of the tubular components. For example, the brush component 11 and its brush 5 may be directly connected to the operating handle 4 and the device used as a deck brush.

We claim:

1. A boat bottom scrubbing device comprising:

an elongated support having an axis and first and second opposite ends, the support being formed so that at least part of the support forms a concave member and said axis lying in a plane;

a brush including a base and scrubbing means thereon, the scrubbing means extending on opposite sides of said plane;

means connecting said base and said first end;

an operating handle having an axis and having a loop member, last said axis and the loop member lying in said plane;

means connecting said operating handle to said second end; and said loop member having first and second spaced apart hand-grip sections, at least, one of which is off-set from said support axis and the hand-grip sections lying in said plane.

2. The device of claim 1 wherein said scrubbing means is comprised of a plurality of bristles mounted on and extending outwardly from said base and arranged in a center section and a pair of outboard sections respectively disposed on opposite sides of the center section, the locus of the outer ends of the bristles of the center section lying in a plane and in each outboard section, the locus of the outer ends of the bristles lying in a plane, the respective last said planes each being oriented at an obtuse angle to the plane of said center section and the axis of said support at said first end extending parallel to the plane containing the locus of the outer ends of the bristles of one of said outboard sections and also extending perpendicular to the plane containing the locus of the outer ends of the bristles of the other of said outboard sections.

3. The device of claim 1 further including coupling means connecting said operating handle and said second end and providing of said loop member to be positioned alternatively in a position wherein the loop member extends in a direction toward the inside of said concave member or in a position wherein the loop member extends in a direction away from said concave member.

* * * * *